US005680735A

United States Patent [19]

Bates

[11] Patent Number: 5,680,735

[45] Date of Patent: Oct. 28, 1997

[54] MODULAR BUIDING SYSTEM

[76] Inventor: Gary Grant Bates, 24765 Bell Rd., New Boston, Mich. 48164

[21] Appl. No.: 400,350

[22] Filed: Mar. 8, 1995

[51] Int. Cl.[6] ..... E04B 2/08; E04B 2/18; E04B 2/32; E04B 2/46

[52] U.S. Cl. ..... 52/591.5; 52/223.7; 52/271; 52/220.2; 52/582.2; 52/587.1; 52/592.5

[58] Field of Search ..... 52/223.7, 266, 52/271, 591.1, 591.4, 591.5, 587.1, 582.2, 592.4, 592.5, 220.2, 220.3, 220.4

[56] References Cited

U.S. PATENT DOCUMENTS

| | | | |
|---|---|---|---|
| 178,988 | 6/1876 | Borie . | |
| 746,399 | 12/1903 | Staples | 52/591.5 |
| 1,958,799 | 5/1934 | Playford . | |
| 2,482,719 | 9/1949 | Rigaumont | 52/591.1 |
| 2,877,506 | 3/1959 | Almoslino . | |
| 2,888,779 | 6/1959 | Hostetter . | |
| 3,102,367 | 9/1963 | Pedersen et al. . | |
| 3,256,657 | 6/1966 | Phipps | 52/223.7 |
| 3,269,070 | 8/1966 | Stoy | 52/591.1 X |
| 3,410,044 | 11/1968 | Moog | 52/591.1 X |
| 3,432,978 | 3/1969 | Erickson | 52/223.7 |
| 3,621,624 | 11/1971 | Gustafson | 52/223.7 X |
| 4,058,943 | 11/1977 | Sturbill | 52/223.7 |
| 4,407,104 | 10/1983 | Francis . | |
| 4,411,118 | 10/1983 | Claver | 52/582.2 |
| 4,428,174 | 1/1984 | Grady, II | 52/223.7 X |
| 4,473,985 | 10/1984 | Hunt | 52/592.6 |
| 4,614,071 | 9/1986 | Sams et al. | 52/591.4 X |
| 4,648,226 | 3/1987 | Manon | 52/591.1 X |
| 4,833,855 | 5/1989 | Winter, IV | 52/591.4 |
| 4,854,103 | 8/1989 | Klym . | |
| 4,982,535 | 1/1991 | Pickett . | |
| 5,003,746 | 4/1991 | Wilston . | |
| 5,020,938 | 6/1991 | Scales . | |
| 5,081,807 | 1/1992 | Murdza . | |
| 5,138,809 | 8/1992 | Saikachi . | |
| 5,154,032 | 10/1992 | Ritter . | |
| 5,181,362 | 1/1993 | Benitez . | |
| 5,182,886 | 2/1993 | Bateman et al. . | |
| 5,186,883 | 2/1993 | Beall, III . | |
| 5,191,754 | 3/1993 | Story . | |
| 5,205,090 | 4/1993 | Lavery . | |
| 5,230,194 | 7/1993 | McClure . | |
| 5,261,205 | 11/1993 | Sandor | 52/591.4 |
| 5,265,750 | 11/1993 | Whiteley et al. . | |
| 5,465,541 | 11/1995 | Un et al. | 52/592.4 X |

FOREIGN PATENT DOCUMENTS

| | | | |
|---|---|---|---|
| 2756863 | 6/1978 | Germany | 52/591.5 |

*Primary Examiner*—Christopher T. Kent
*Assistant Examiner*—Yvonne Horton-Richardson
*Attorney, Agent, or Firm*—Brooks & Kushman P.C.

[57] ABSTRACT

A modular building system comprising one or more wall panels having a top edge defining one of a male or female configuration and a bottom edge defining the other one of a male or female configuration such that the top edge of one wall panel can mate with the bottom edge of an upper wall panel. The wall panels also have a first side edge defining one of a male or female triangular interlock and a second side edge defining the other one of a male or female triangular interlock such that the first side edge of one wall panel can interlock with the second side edge of another wall panel. Additionally, the wall panels have a clip extending from one wall panel to another to secure the first side edge of the one wall panel in position with the second side edge of another wall panel.

22 Claims, 7 Drawing Sheets

Fig. 1
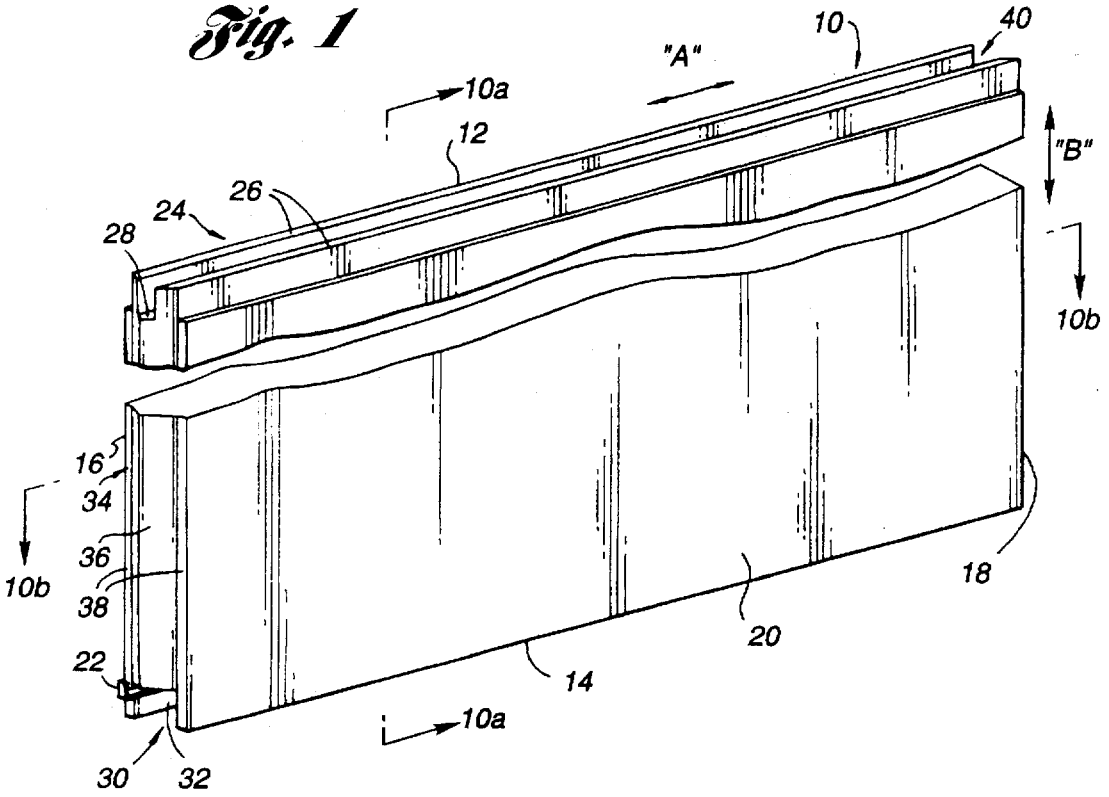
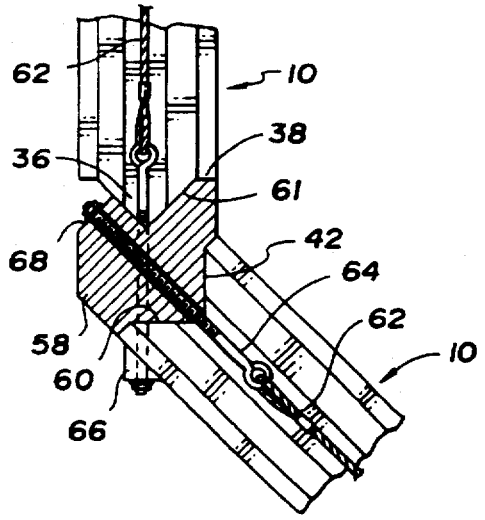
Fig. 2
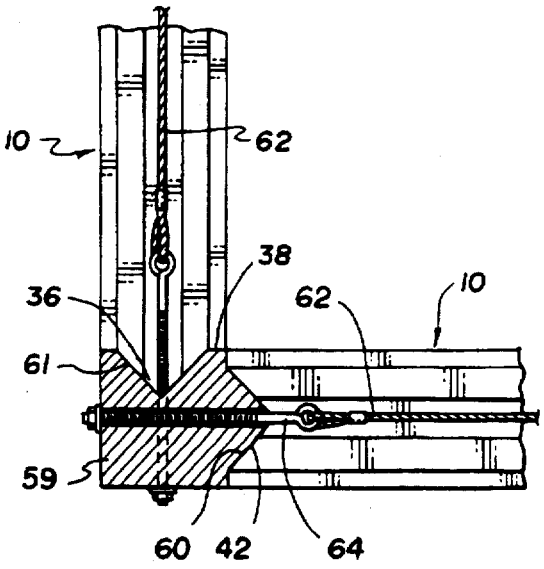
Fig. 3

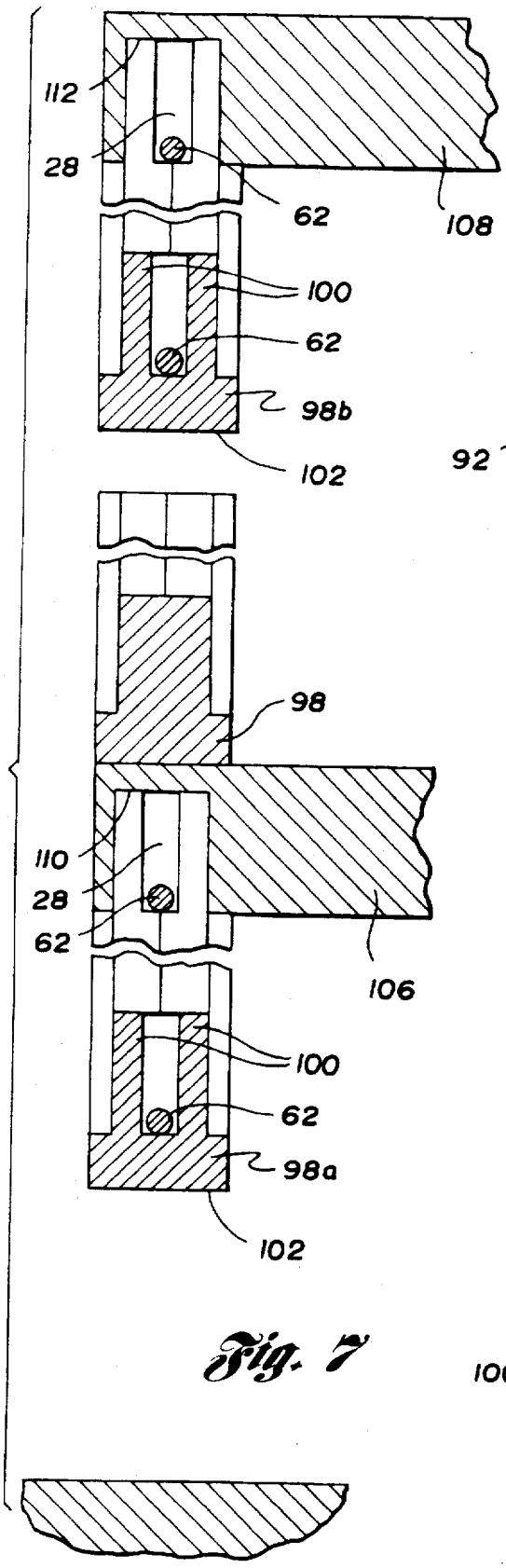
Fig. 7
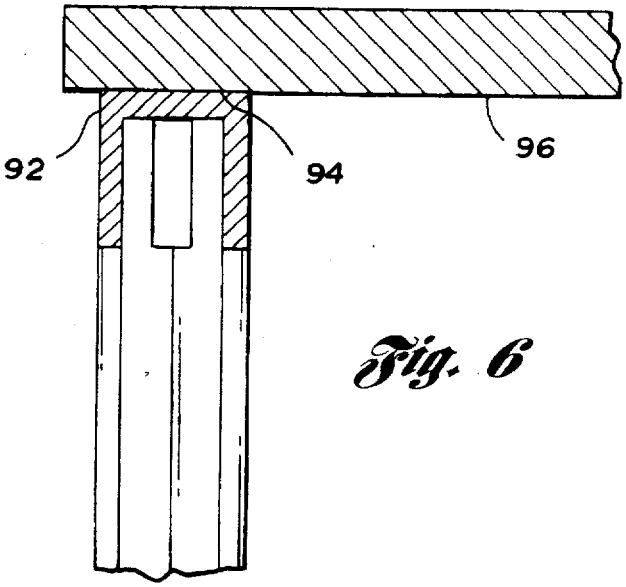
Fig. 6
Fig. 8
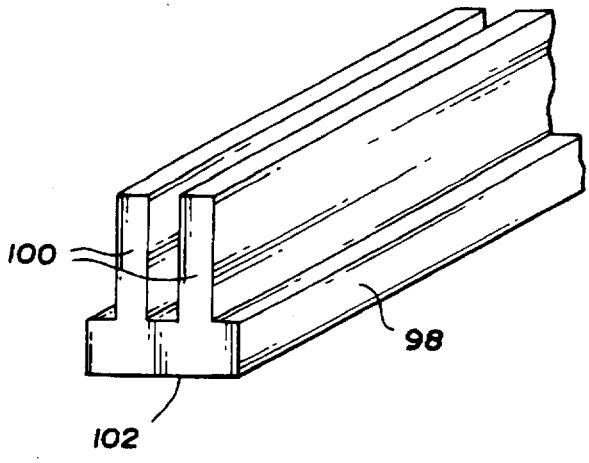

MODULAR BUIDING SYSTEM

TECHNICAL FIELD

The present invention is related to a modular building system for use in the construction of buildings or other structures.

BACKGROUND ART

The use of prefabricated components in the construction of buildings has been used for years. For example, U.S. Pat. No. 5,182,886 to Bateman et al. discloses building blocks or bricks which may be bonded together in a factory, using an appropriate mortar, to produce a prefabricated panel. A concrete or metal beam is provided at both the top and the bottom of the panel and vertical threaded tie bolts are tightened between the concrete or metal beams to tie together the blocks or brick comprising each panel through compression.

The disadvantages inherent in the panels disclosed by the Bateman et al. patent are several. First, while the prefabricated building panels save work at the construction site, assembly of individual building blocks or bricks and the concrete beams require additional work time at the factory. Second, the top or bottom edges of these panels do not offer any features for erecting one panel on top of another panel.

Furthermore, the ends of the panels disclosed in Bateman et al. do not offer any means for guiding the panels together, nor for locking the panels together, but instead rely on a separate labyrinth seal structure which has to be erected between adjacent edges of two wall panels. The use of this labyrinth seal structure adds yet another piece to be erected during construction and accordingly adds to the erection time required. In the construction business, it is desirable to eliminate construction steps while maintaining the aesthetics and structural durability of a building or structure under construction. The elimination of construction steps saves time and money.

U.S. Pat. No. 4,982,535, issued on Jan. 8, 1991, to Pickett, discloses a barrier structure comprising prefabricated reinforced concrete panels. One end of each panel has an arched concave surface while the other has a radiused convex surface. The panels are assembled side-to-side such that a radiused convex surface of one panel sits within the arched concave surface of another panel. The panels also define vertical tunnels and are connected vertically via a rod, externally threaded at both ends, which is threaded through aligned tunnels placed under tension by using cylinders at each end having a threaded throughbore.

Like Bateman et al., the system disclosed by Pickett also has disadvantages. First, the manufacture of prefabricated reinforced concrete panels is time consuming and costly. Such manufacture requires that steel reinforcement be placed at specified locations prior to the formation of the panel. Each panel must then be cured before it can be used in the field.

Second, because the only abutting surfaces between adjacent panels are the radiused convex surface of one panel and the arched concave surface of another panel, the panels can easily slide or disengage from each other during construction.

Third, this system does not make any allowance for placing utility lines or other service lines within the wall itself. Because all surfaces of adjacent panels are fit snugly together, conduits for utility or other service lines must be manually created during manufacture of the panels or in the field during construction.

Fourth, these panels provide nothing to assist the assembly of adjacent panels to achieve a snug fit. Instead, panels must be manually shifted into a snug-fit condition, so that the vertical tunnels are aligned, before inserting the threaded rod through the vertical tunnels.

Accordingly, it is desirable to provide a modular building system comprising modular wall panels which can be easily manufactured and assembled in a secure and snug-fit relationship and which also provide for the running of utility and other service lines within the wall panels.

SUMMARY OF THE INVENTION

An object of the present invention is to provide an improved modular building system comprising modular wall panels which are easy to manufacture, which can be easily assembled in a secure and snug-fit relationship to each other, and which provide conduits for the running of utility and other service lines within the modular wall panels.

In carrying out the above objects, the present invention is a modular building system comprising wall panels having a top edge defining one of a male or female configuration and a bottom edge defining the other one of a male or female configuration such that the top edge of one wall panel can mate with the bottom edge of another wall panel. The wall panels also have a first side edge defining one of a male or a female triangular interlock and a second side edge defining the other one of a male or female triangular interlock such that the first side edge of one wall panel can interlock with the second side edge of another wall panel. The wall panels also have a clip extending from one wall panel to another wall panel such that the first side edge of the one wall panel is held in position with the second side edge of another wall panel.

Because of the male and female configurations, assembly of this modular building system in a vertical multi-tier direction is very easy. Likewise, the male and female triangular interlocks make lateral assembly of the wall assembly very simple. The angles inherent in the male and female triangular interlocks assist the assembler in guiding the wall panels together into a snug fitting relationship. The angles of the triangular interlock also help to keep adjacent wall panels in the correct position before or while the clip is used to tie laterally adjacent wall panels together.

In a preferred embodiment, the clip comprises a clip member which is connected to one wall panel and which has a vertical clip portion which is designed to fit within a vertical aperture of another adjacent wall panel. In a particularly preferred embodiment, the vertical portion of the clip has a sloped vertical face designed to engage the vertical aperture and pull the adjacent wall panels into a closely abutting relationship during assembly. Through the use of such a clip, assembly of adjacent wall panels into a closely abutting relationship is simplified.

In another preferred embodiment of this invention, the male configuration defines a cable notch extending from the first side edge to the second side edge of the wall panel. This cable notch can be used in conjunction with a cable having a cable locking mechanism which can be threaded through the cable notch between two or more wall panels and locked, under tension if desired, in order to laterally tie adjacent wall panels together. Furthermore, utility and other service lines can be run through the cable notch within the wall panels. Thus, it is not necessary during construction to create utility or service line conduits through the wall panels.

Another benefit accruing from the use of this system is that, due to the geometry of the wall panels, they can be manufactured through an extrusion process. This not only greatly simplifies manufacture of these wall panels, but allows the use of such recycled materials as plastics.

Further objects and advantages of this invention will be apparent from the following description, with reference being had to the accompanying drawings.

BRIEF DESCRIPTION OF THE DRAWINGS

While embodiments of the invention are illustrated, the particular embodiments shown should not be construed to limit the claims. It is anticipated that various changes and modifications may be made without departing from the scope of this invention.

FIG. 1 is a perspective view with a break line of a typical wall panel of the present invention;

FIG. 2 is a cross-sectional view showing a corner piece to be used at a 45° intersection of two wall panels of the present invention;

FIG. 3 is a cross-sectional view showing the corner piece used at the 90° intersection of two wall panels and the use of tension rods;

FIG. 6 is a cross-sectional view taken along line 6—6 of FIGS. 4*a* or 4*b*, showing an alternative roof support construction;

FIG. 7 is a cross-sectional view taken along line 7—7 of FIGS. 4*a* or 4*b*, showing a typical wall construction using the wall panels of the present invention and showing lintels used at door and window openings and alternative floor and roof construction;

FIG. 8 is a perspective view of a typical lintel of the present invention;

BEST MODE FOR CARRYING OUT THE INVENTION

Figure 4A:
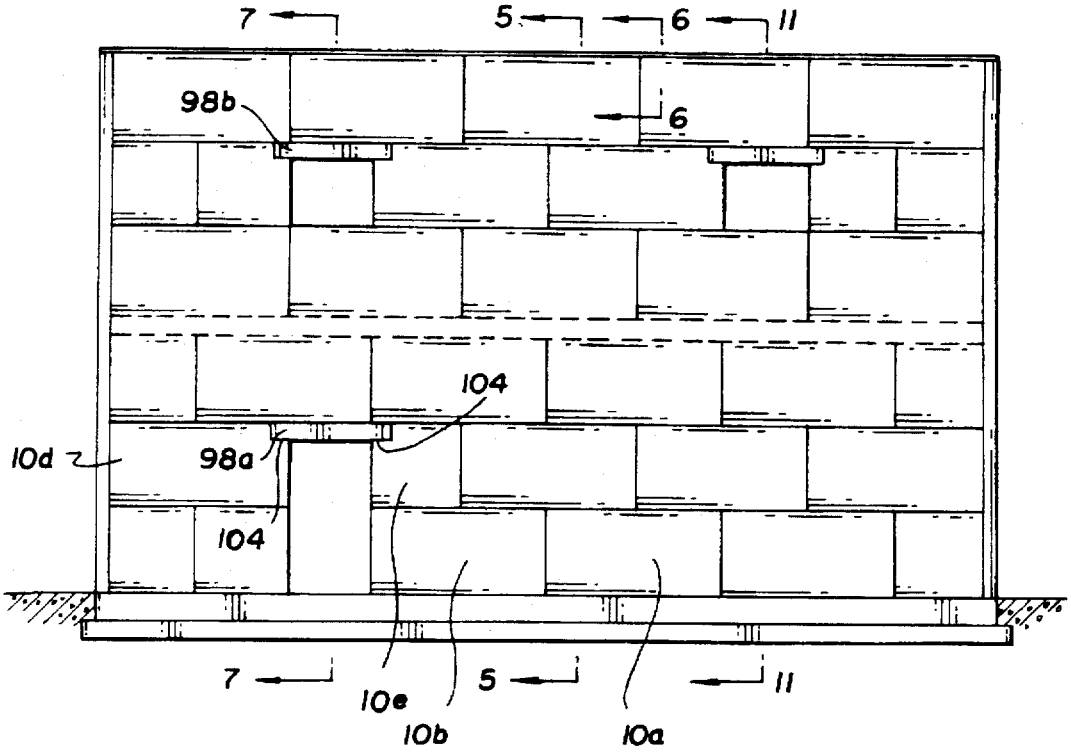
FIG. 4*a* is an elevational view of a structure built with the wall panels of the present invention.

One embodiment of the modular building system is illustrated in FIGS. 1–9. As shown in FIG. 1, the modular building system of the present invention comprises wall panels 10 having a top edge 12, a bottom edge 14, a first side edge 16, a second side edge 18, side surfaces 20 and an erection clip 22.

Figure 5A:
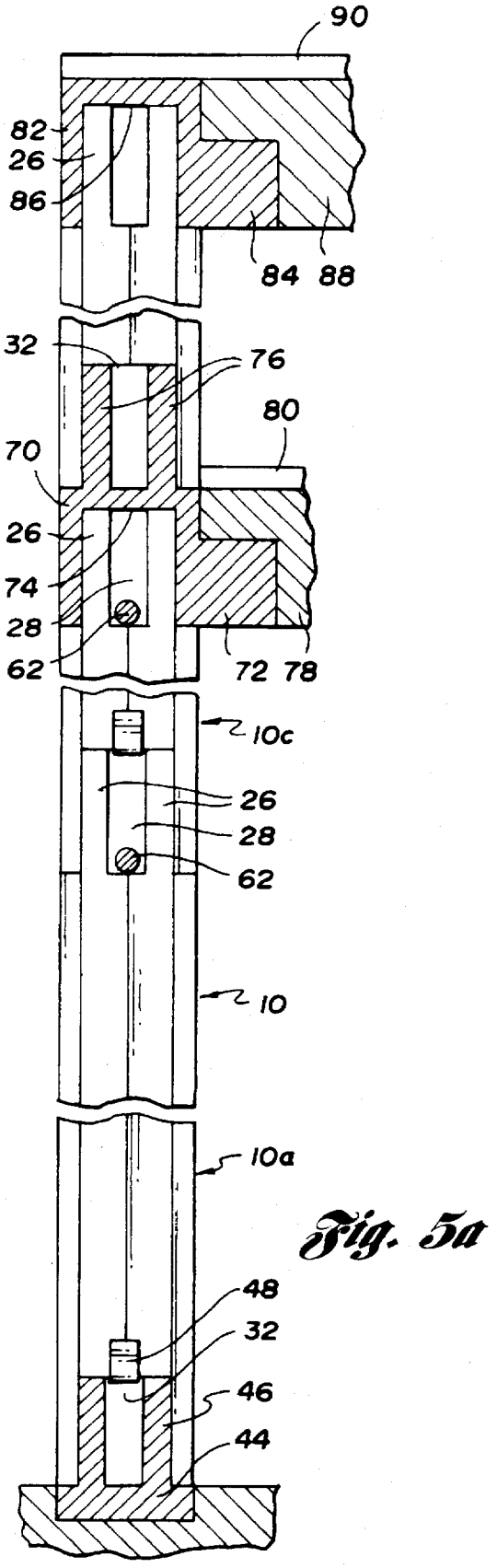
FIG. 5*a* is a cross-sectional view taken along line 5—5 of FIG. 4*a*, showing a typical wall built from the wall panels of the present invention and showing the floor and roof supports.
Figure 5B:
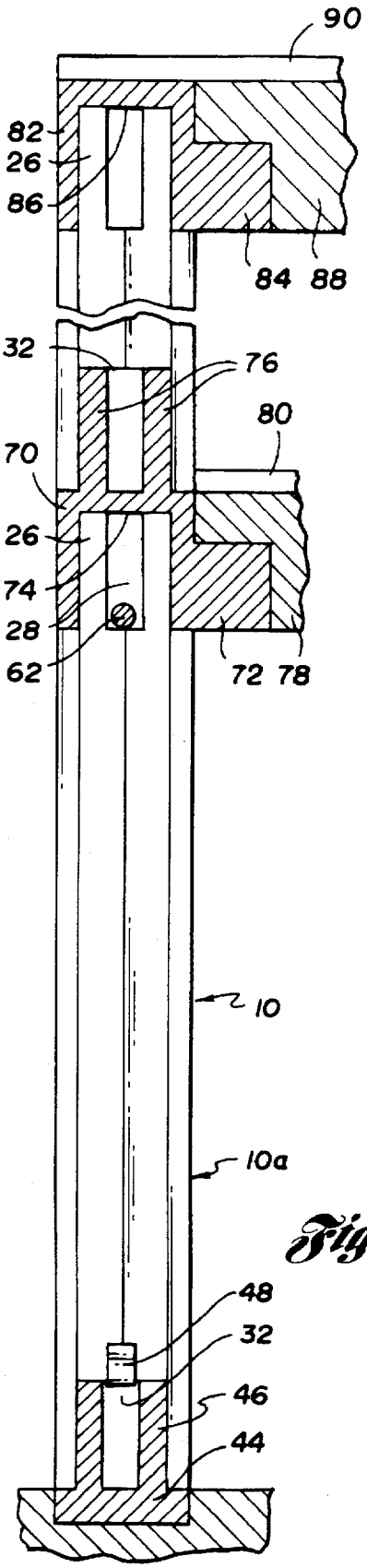
FIG. 5*b* is a cross-sectional view taken along line 5—5 of FIG. 4*b*, showing a typical wall built from alternative wall panels of the present invention.

As shown in FIGS. 1 and 5*a* or 5*b*, the top edge 12 defines a top male configuration shown generally at 24. The top male configuration 24 of this embodiment comprises two male projections 26 which are both offset inwardly from the side surface 20 of the wall panels 10. The slot 28 defined by the male projections 26 can be used for running utility or other service lines or for utilizing tension rods during construction, as will be disclosed in greater detail.

The bottom edge 14 defines a bottom female configuration shown generally at 30. The bottom female configuration 30 of this embodiment comprises a female groove 32 having a width equal to, or slightly greater than, the outside width between the two male projections 26.

As shown in FIGS. 1–3, the first side edge 16 defines a side male interlock, shown generally at 34, which in this embodiment comprises a triangular projection 36. While the width of the triangular projection 36 could be equal to the width of the wall panel 10, it is preferred that the width of the triangular projection 36 be slightly less so that a flat side edge portion 38, approximately perpendicular to the side surface 20 of the wall 10, is provided on each side of the triangular projection 36.

The second side edge 18 defines a side female interlock, shown generally at 40, which in this embodiment comprises a triangular groove 42. As shown in FIG. 3, the triangular groove 42 has approximately identical dimensions to the triangular projection 34 such that first side edge 16 can mate with a second side edge 18 of another identical wall panel 10 during construction of the modular building system.

Figure 4B:
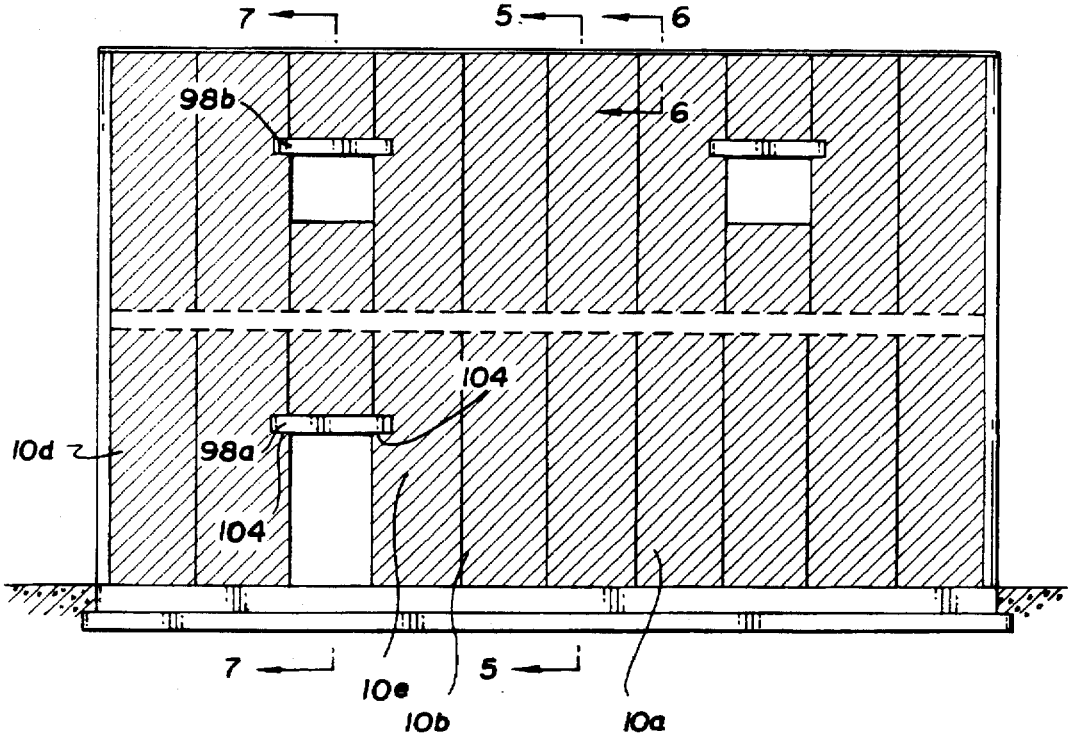
FIG. 4*b* is an elevational view of a structure built with alternative wall panels of the present invention.

FIGS. 4*a* and 4*b* show an elevational view of a building structure built using the wall panels of the present invention having two different dimensional configurations. As shown in FIGS. 4*a* and 5*a*, or FIGS. 4*b* and 5*b*, the modular building system of this invention can be used by first mounting a footing block 44 to the foundation of the structure being built. The footing block 44 may be mounted to the foundation by embedment or through the use of preset anchor bolts, anchor screws, mortar, or any other suitable construction method. Because such methods are well known in the art, they will not be described further here.

The footing block 44 has a cross-sectional geometry virtually identical to the top edge 12 of the wall panel 10, and has two footing prongs 46 identical to the two male projections 26 of the male configuration 24. Accordingly, as shown in FIGS. 4*a* and 5*a*, or FIGS. 4*b* and 5*b*, a wall panel 10*a* may be erected by placing the panel 10*a* atop a footing block 44 such that the footing prongs 46 of the footing block 44 interlock with the female groove 32 of the wall panel 10*a*. Prior to such erection, mortar or any other suitable construction adhesive may be applied to the top edge of the footing block 44 or to the bottom female interlock 30 of the wall panel 10*a* in order to bind the footing block 44 to the wall panel 10*a*. Because such mortars or adhesives are generally well known in the art, they will not be described further here.

Figure 9:
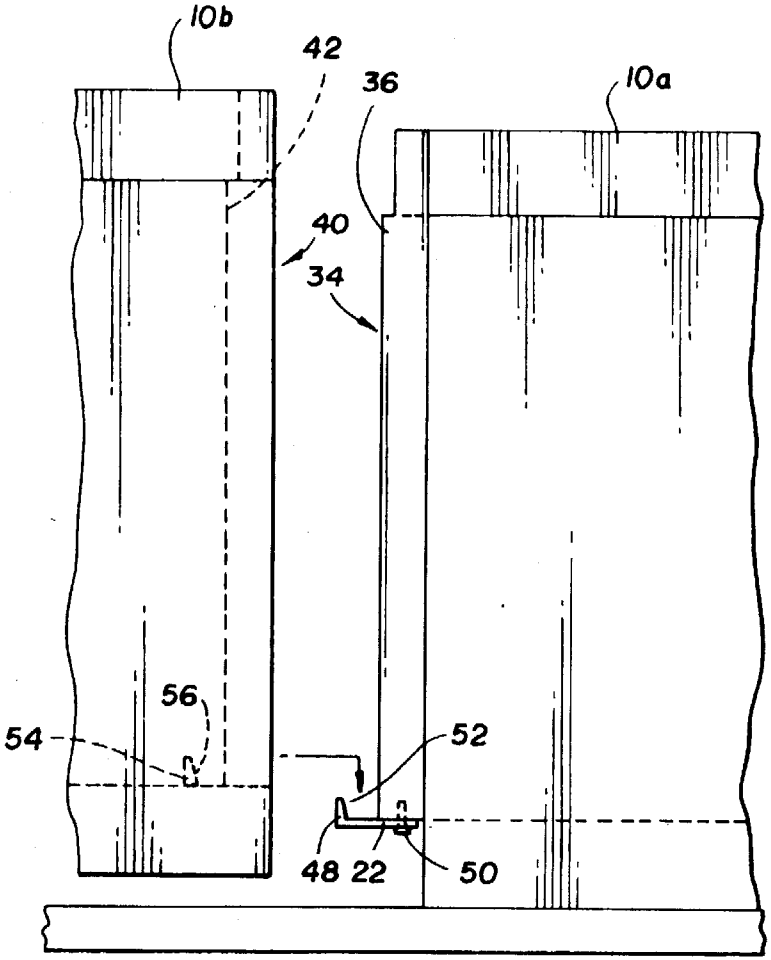
FIG. 9 is an elevational view of the ends of two typical wall panels of the present invention illustrating assembly of the wall panels.

In order to facilitate erection, a connector may be used to engage or connect the wall panels together. As shown in FIGS. 1 and 9, the wall panel 10*a* has a connector which comprises an erection clip 22. In the embodiment shown, the erection clip 22 of wall panel 10*a* comprises an L-shaped steel piece having an upstanding leg 48 and fastened to the bottom of the female groove 32 via a screw 50 or other suitable fastener. The erection clip 22 could be made from A36 bar stock or any other suitable material. The upstanding leg 48 has a tapered clip surface 52 slightly sloped such that the bottom of the upstanding leg 48 is thicker than the top.

The wall panel 10*b* to be erected adjacent to and adjoining wall panel 10*a* has an erection cavity 54. The erection cavity 54 has a cavity wall 56 slightly tapered to coincide with the tapered surface 52 of the upstanding leg 48 of the erection clip 22.

As shown in FIGS. 4*a* or 4*b* and 9, during construction and after the wall panel 10*a* has been erected atop the footing block 44, a second wall panel, such as wall panel 10*b* shown in FIG. 9, can be erected. The wall panel 10*b* is erected by placing it into position, at an elevation slightly higher than wall panel 10*a* such that the triangular projection 36 of wall panel 10*a* fits into triangular groove 42 of wall panel 10*b*. Wall panel 10*b* is then lowered such that the upstanding leg 48 of the erection clip 22 engages the erection cavity 54. The tapered surface 52 of the upstanding leg 48 will then engage the tapered cavity wall 56 and draw the wall panels 10*a* and 10*b* together into a closely abutting relationship.

Mortar or any other suitable construction adhesive may be applied to the side male interlock configuration 34 of wall panel 10*a* or the side female interlock configuration 40 of wall panel 10*b* before such assembly in order to bind the wall panels together. Because such mortars or construction adhesives are generally well known in the art, they will not be described further here.

FIGS. 2 and 3 illustrate the use of corner pieces. FIG. 2 illustrates the use of a 45° corner piece 58 while FIG. 3 illustrates the use of a 90° corner piece 59. Note that each corner piece defines a male side interlock 60 and a female side interlock 61 virtually identical to the side male interlock 34 and the side female interlock 40 of the wall panel 10. In using the method of this invention, it is possible to supply corner pieces in an infinite variety of angles and geometrical configurations.

As shown in FIGS. 2, 3, 5*a* or 5*b* and 7, adjacent wall panels may be tied together and placed under lateral tension via tension cables 62 threaded through the slot 28 at the top edge 12 of each wall panel. This tension cable 62 may comprise any suitable steel cable or other cable material suitable for post construction tension applications.

As shown in FIGS. 2 and 3, the tension cable 62 may be secured at each end to an eyebolt assembly 64. After being secured, the nut of the eyebolt assembly 64 may be tightened, to apply the desired tension along the tension cable 62 thereby compressing adjacent wall panels together. As shown in FIG. 2, if the geometrical configuration of the corner piece used has an exterior surface which is not perpendicular to the longitudinal axis of the eyebolt assembly, it may be desirable to employ a beveled washer 66 or, alternatively, to provide a perpendicularly faced recess 68 in the corner piece.

As shown in FIGS. 4*a* and 5*a*, the panels are assembled in the vertical direction by simply placing a panel 10*c* atop another panel 10*a* such that the male interlock configuration 24 and female interlock configuration 30 engage. As with the side-to-side assembly, mortar or other suitable construction adhesives may be used during such assembly. Because such mortars or construction adhesives are generally well known in the art, they will not be described further here.

As shown in FIGS. 4*a* or 4*b*, 7 and 8, special prefabricated pieces may be used as lintels to span door, window or other desired openings. Furthermore, as shown in FIGS. 4*a* or 4*b*, 5*a* or 5*b* and 7, special prefabricated pieces may be used as floor or roof beams or as floor or roof supports.

For example, as shown in FIG. 5*a* or 5*b*, an intermediate floor support 70 having a floor support projection 72 may be employed at any elevation where it is desired to construct a floor. The intermediate floor support 70 has a bottom female configuration comprising a floor support groove 74 virtually identical to the female groove 32 of the wall panel 10 such that the floor support piece 70 may be erected by simply interlocking the floor support groove 74 with the two male projections 26 of the underlying wall panel. The floor support piece also has a top male configuration comprising two floor support projections 76 virtually identical to the two male projections 26 of the wall panel 10 such that another wall panel may be erected on top of the floor support piece 70 by simply interlocking the intermediate projections 76 with the female groove 32 of the overlying wall panel. Similar to the assembly of all other pieces described, mortar or any other suitable construction adhesive may be applied between the floor support pieces 70 and any wall panels. Because such mortars or adhesives are generally well known in the art, they will not be described further here.

In order to construct a floor, floor joists or beams 78 may be erected to bear upon a floor support projection 72. The connection between the floor joists or beams 78 and the floor support projection 72 may be made by bolting, screwing, or any other suitable construction connection method. Because such connection methods are generally well known in the art, they will not be described further here. The floor can then be completed by spanning the desired floor material 80 between the floor joist or beams 78.

Similarly, as also shown in FIG. 5*a* or 5*b*, a roof cap piece 82 having a roof support projection 84 may be employed at the top of a wall constructed pursuant to the method of this invention. The roof cap piece 82 has a roof cap groove 86 virtually identical to the female groove 32 of the wall panel 10 such that the roof cap piece 82 may be erected by simply interlocking the roof cap groove 86 of the roof cap piece 82 with the two male projections 26 of the underlying wall panel. Similar to the assembly of all other pieces described, mortar or any other suitable construction adhesive may be applied to the top edge 12 of the wall panel or to the cap groove 86 in order to bind the wall panel and cap piece 82 together.

In order to construct the roof, roof joists or beams 88 may be erected so as to bear on the roof support projection 84 of the roof cap piece 82. The roof joists or beams 88 may be connected to the roof support projection 84 by bolting, screwing or any other suitable construction connection method. Because such connection methods are well known in the art, they will not be described further here. Roof panels 90 may then be erected spanning the roof joists or beams 88.

Alternatively, as shown in FIG. 6, the roof cap piece 92 need not have a roof support projection but instead may simply have a top bearing surface 94. In this case, the roof joists or beams 96 simply bear on the top bearing surface 94 of the roof cap piece 92. This type of arrangement is desirable because bearing loads from the roof are distributed along the center line of the underlying wall panels.

As shown in FIG. 7, lintels 98*a* and 98*b* may be used to span door, window or other openings. As shown in FIGS. 7 and 8, the typical lintel 98 has two lintel projections 100 which are substantially identical to the two male projections 26 of the wall panel 10. The bottom surface 102 can be planar or have any other geometrical configuration desired to facilitate construction of the door, window or other opening. As shown in FIGS. 4*a* or 4*b* and 7, the lintel 98 may be used by simply cutting out a top corner portion 104 of the wall panels 10*d* and 10*e* adjacent the desired opening such that the lintel 98 will bear upon the cut out portion 104 and the lintel projections 100 are aligned with the male projections 26 of the wall panels 10*d* and 10*e*. The lintel 98 may be connected to the wall panels upon which it bears by using bolts, screw or any other suitable construction connection method. Because such connection methods are well known in the art, they will not be described further here.

Because the male projections formed by the lintel projections 100 and the panel projections 26 are now aligned, overlying wall panels can be erected in the manner already set forth. Unless the opening is unusually wide, it will not usually be necessary reinforce the lintel 98 because the overlying wall panels should be able to span the opening without additional structural support from the lintel 98.

As also shown in FIG. 7, and in lieu of the construction set forth in FIG. 5*a* or 5*b*, the floor and roof construction may alternately consist of floor panels 106 and roof panels 108 which have a female floor groove 110 and female roof groove 112 respectively. In the case such a floor panel 106 is used, overlying wall panels can be erected by simply connecting a block having the configuration of a footing block 44 or lintel 98 to the top surface of the floor panel 106 using any suitable construction connection method. Because such connection methods are well known in the art, they will not be described further here. The advantage of using such floor panels 106 and roof panels 108 is that bearing loads will be distributed along the center line of the wall panels.

An additional advantage of the wall panels described is that they may be manufactured easily via an extrusion process. During such a process, the wall panel 10 as shown in FIG. 1 could be extruded through a die in the direction designated "A." The die would have the appropriate shape to form the desired top edge 12 and bottom edge 14 configurations as the wall panel 10 is being extruded. Depending upon the length of the wall panel desired, the panels being extruded would be cut such that the extruded panel would have a second side edge 18 defining the triangular groove 42 while the first side edge 16 of the wall panel being extruded would define a triangular projection 36, or vice versa. It is alternatively possible that the wall panel 10 as shown in FIG. 1 could be extruded through a die in the direction designated "B." The die would have the appropriate shape to form first side edge 16 and second side edge 18 as the wall panel 10 is being extruded. Depending upon the height of the wall panel desired, the panels being extruded would be cut such that the extruded panel would have a bottom edge 14 configuration while the top of the wall panel being extruded would define a top edge 12 configuration.

While in the embodiment shown in FIGS. 4*a* and 5*a* it is expected that such wall panels would generally have the dimensions of three to four feet high by eight to nine feet long by six to twelve inches in width, these dimensions can obviously be varied.

For instance, FIG. 4*b* shows an elevational view of a building structure built using wall panels of the present invention having preferable dimensions of 9 to 14 feet high by 3 to 6 feet long by 6 to 12 inches in width. As shown in FIGS. 4*b* and 5*b*, the modular building system of this embodiment allows wall panels 10*b* to be erected such that they span the dimension between each floor of the structure. Similar to the embodiment shown in FIGS. 4*a* and 5*b*, and as already disclosed, the modular building system of this embodiment is erected in a substantially identical manner. In fact, other than the dimensional change of the wall panels, all other components are substantially identical. Accordingly, no further discussion of the construction methods utilizing this preferred embodiment will be discussed here.

An additional benefit of being able to manufacture these wall panels through an extrusion process is that they may be manufactured from recycled materials, such as plastics. Depending upon the strength and resiliency of the wall panels desired, the material used can be varied. If extremely strong wall panels are required, it may be desirable to add a reinforcing material, such as steel fibers or other reinforcing material, to the extrusion mix before extruding the wall panels.

Figure 10B:
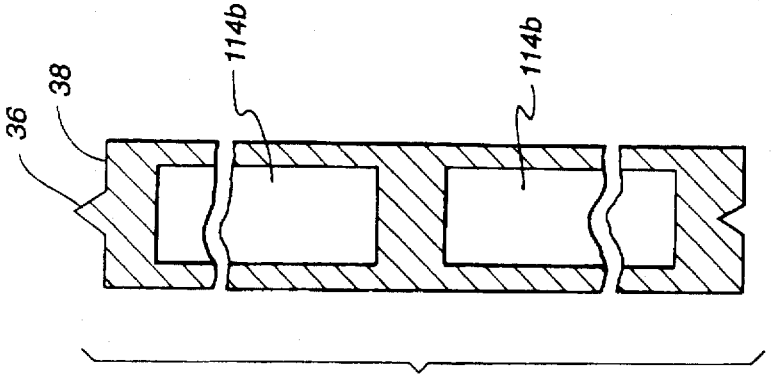
FIG. 10*b* is a cross-sectional view of a typical wall panel of the present invention taken along line 10*b*—10*b* of FIG. 1 which is similar to the embodiment shown in FIG. 1 except that the wall panel in this embodiment has vertical cavities.
Figure 10A:
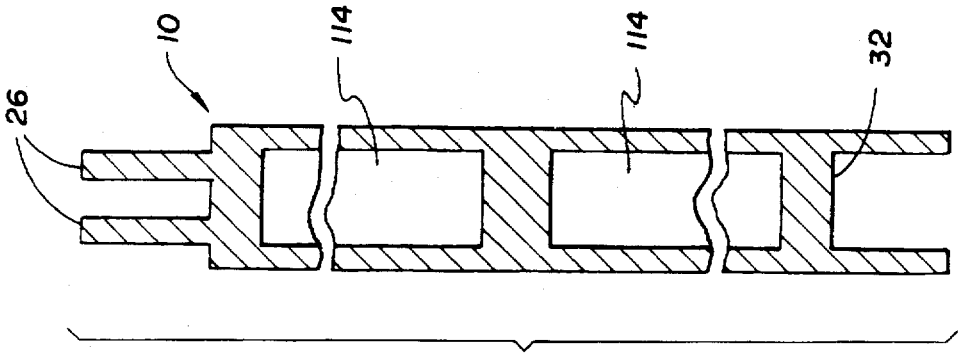
FIG. 10*a* is a cross-sectional view of a typical wall panel of the present invention taken along line 10*a*—10*a* of FIG. 1 which is similar to the embodiment shown in FIG. 1 except that the wall panel in this embodiment has horizontal cavities.

As shown in FIG. 10*a*, and in the interest of saving weight and cost of materials, and to provide larger cavities within the wall for utility lines, insulation, etc., it may be desirable to utilize mandrels during the extrusion process to extrude the wall panels 10 so as to form cavities 114 within the wall panels running the length of the wall panels. In such a case, it is anticipated that the preferred outer wall thickness will be in the range of one-half to one inch. Alternatively, and as shown in FIG. 10*b*, it may be desirable to utilize mandrels during the extrusion process to extrude the wall panels 10 so as to form cavities 114*b* within the wall panels running the height of the wall panels. This is especially preferred in the case of the embodiments depicted in FIGS. 4*b* and 5*b*, the result being a stud-like structure running from floor to floor.

Because the techniques of extrusion are well known in the art, no further discussion will be provided here.

Figure 11:
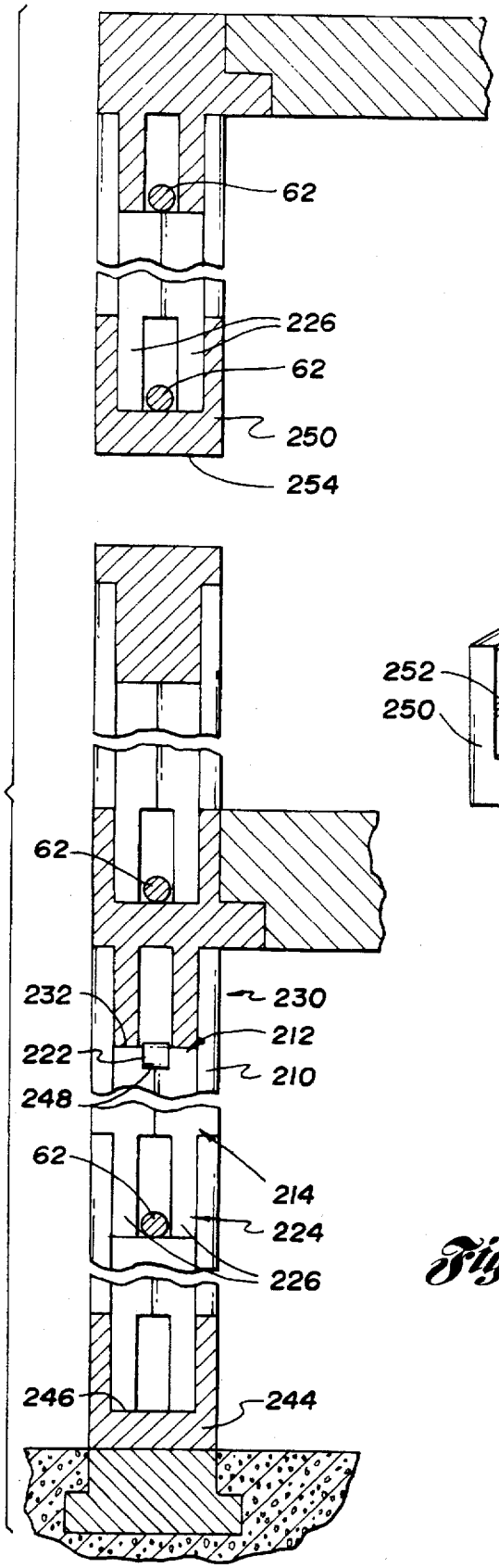
FIG. 11 is a cross-sectional view taken along line 11—11 of FIG. 4*a*, showing a typical wall built from wall panels having the reverse configuration from the wall panel shown in FIG. 1.

The geometry of the modular building system can also be reversed. FIG. 11 illustrates the use of a wall panel 210 which is essentially identical to the wall panel 10 except it has a reverse geometry. The wall panel 210 has a bottom edge 214 defining a bottom male configuration shown generally at 224. The bottom male configuration 224 comprises two male projections 226.

The top edge 212 defines a top female configuration shown generally at 230. The top female configuration 230 comprises a female groove 232 having a width equal to, or slightly greater than, the outside width of the two male projections 226.

While it cannot be seen, the first side edge 216 of this configuration would define a side female interlock 240 while the second side edge 218 would define a side male interlock 234. Similar to wall panel 10, the side male interlock 234 could comprise a triangular projection 236 while the side female interlock 240 could comprise a triangular groove 242.

The footing block 244 used in this embodiment has a cross-sectional geometry virtually identical to the top edge 212 of the wall panel 210, and has a footing groove 246 identical to the female groove 232. The erection is similar to that already described, and mortar or any other suitable construction adhesive may be applied between adjoining members. An erection clip 222 would still be employed identical to the erection clip 22 except upside down. Instead of an upstanding leg 48 it would have a downstanding leg 248 and the erection clip 222 would be fastened to the bottom of the female groove 232 via a suitable fastener (not shown). The adjoining wall panel would have an erection cavity (not shown) identical to the erection cavity 54 already described, except in an upside down orientation.

Construction of adjacent walls would be similar to the construction of wall panels 10*a* and 10*b* already described except positioned in reverse geometrical positions. Lintels 250 used with this embodiment can have a lintel groove 252 identical to the female groove 232 of the panel 210. The bottom surface 254 of this lintel can be planar or have any other geometrical configuration desired to facilitate construction of the doors, windows or other openings. Otherwise, it is used in a similar manner to the lintels 98*a* and 98*b* already discussed except that in this case the lintel groove 252 is aligned with the female groove 232 of the wall panel 210.

Figure 12:
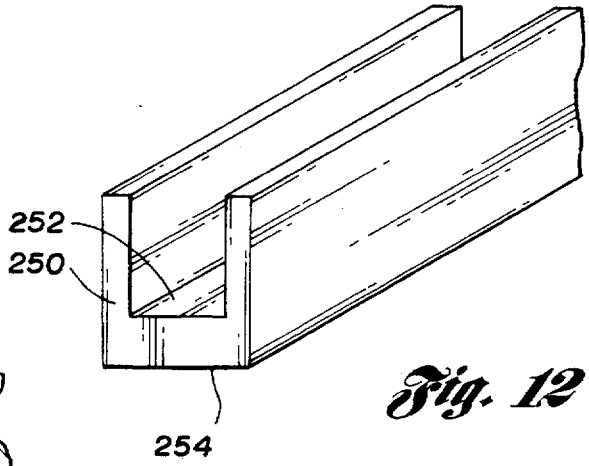
FIG. 12 is a perspective view of a typical lintel to be used with wall panels having the reverse configuration as shown in FIG. 11.
Figure 13:
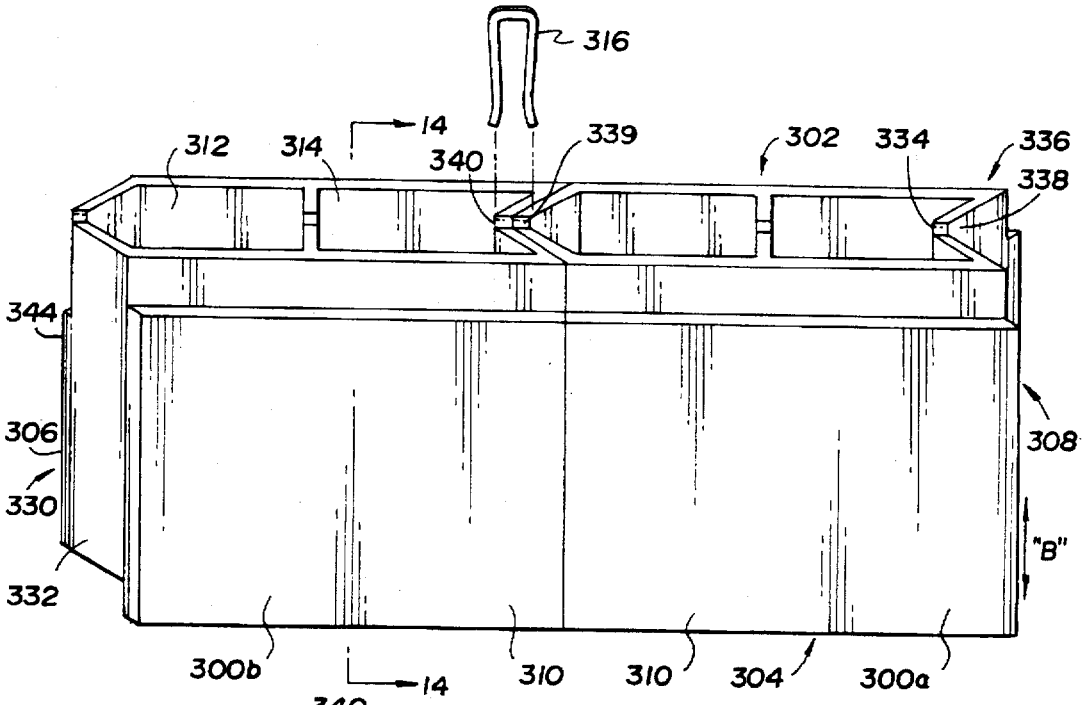
FIG. 13 is a perspective view of a second embodiment of the improved wall panels of the present invention.
Figure 14:
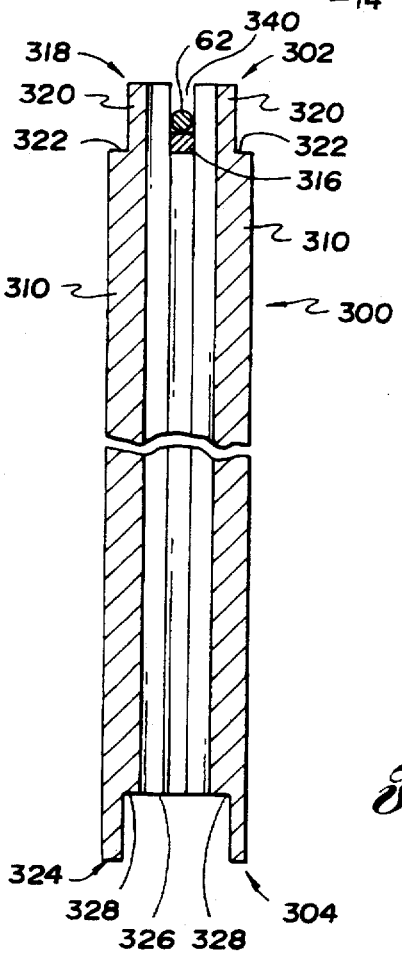
FIG. 14 is a sectional view taken along line 14—14 of FIG. 13.
Figure 15:
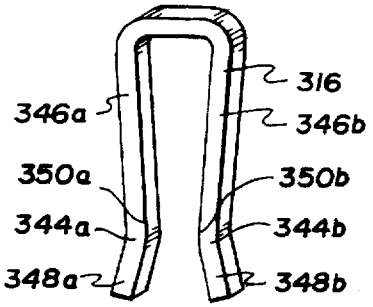
FIG. 15 is a detailed plan view of an erection clip to be used with the embodiment shown in FIG. 13.

An alternative embodiment of the modular building system of this invention is illustrated in FIGS. 12, 13 and 14. As shown in FIG. 13, the modular building system of this embodiment comprises wall panels 300 having a top edge 302, a bottom edge 304, and first side edge 306, a second side edge 308, side walls 310, cavities 312 and 314, and an erection clip 316.

As shown in FIGS. 13 and 14, the top edge 302 defines a top male configuration shown generally at 318. The top male configuration 318 of this embodiment comprises two male projections 320 formed by a right angle recess 322 in the outside corners of the side walls 310.

The bottom edge 304 defines a bottom female configuration shown generally at 324. The bottom of the female configuration 324 of this embodiment comprises a female groove 326 having a width equal to or slightly greater than, the outside width between the two male projections 320. The female groove 326 is defined by right angle recesses 328 formed in the inside corners of the bottom of the side walls 310.

As shown in FIG. 13, the first side edge 306 defines a side male interlock, shown generally at 330, which in this embodiment comprises a triangular projection 332 which is equal to the width of the wall panel 10.

The second side edge 308 defines a side female interlock, shown generally at 336, which in this embodiment comprises a triangular shaped groove 338 which is equal to the width of the wall panel 10.

As shown in FIG. 13, the triangular groove 338 has approximately identical dimensions to the triangular projection 332 such that the first side edge 306 of wall panel 300*a* can mate with the second side edge 308 of another identical wall panel 310*b* during construction of the modular building system.

Similar to the embodiments shown in FIGS. 1–10*b*, the modular building system of this embodiment can be used by first mounting a footing block, substantially identical to footing block 44 shown in FIG. 5, to the foundation of the structure being built. The top of the footing block used with this embodiment should have a cross-sectional geometry identical to the top edge 302 of the wall panel 300. Similar to the embodiment shown in FIG. 5*a* or 5*b*, the wall panel 300 may then be erected by placing the panel 300 atop the footing block 44 such that the footing prongs 46 of the footing block 44 interlock with the female groove of the wall panel 300.

As shown in FIG. 13, wall panels are erected adjacently by mating the triangular projection 332 of one wall panel 300*a* with the triangular groove 336 of another wall panel 300*b*. The adjacent wall panels 300*a* and 300*b* are then drawn tightly together through the use of a connector which in this embodiment comprises an erection clip 316 which is driven down into clip grooves 339 and 340 having a width equal to or slightly greater than the width of the erection clip 316 and cut vertically into the top center of the triangular groove 338 and the triangular projection 332 respectively. The erection clip 316 can be formed of any appropriate material, such as steel, and has a generally U-shaped configuration having two prongs 344*a* and 344*b*. The erection clip 316 could be formed from bar stock having a rectangular cross-section, as depicted, or from rod stock having a circular cross-section.

The two prongs 344*a* and 344*b* of the erection clip 316 have locking portions 346*a* and 346*b* which are sloped slightly towards each other and widened guiding prong portions 348*a* and 348*b* to facilitate use of the erection clip 316. In general, the distance between the widened prong portions 348*a* and 348*b* at their widest separation should have a dimension such that the widened prong portions 348*a* and 348*b* may engage the inner surface of the triangular projection 332 of panel 300*a* and the inner surface of the triangular groove 338 of panel 300*b* such that the prongs 344*a* and 344*b* of the erection clip 316 will be spread apart slightly as the erection clip 316 is driven down into the clip grooves 338 and 340. The clip contact points 350*a* and 350*b*, the points at which the prongs 344*a* and 344*b* are in nearest proximity, will likewise be spread apart during such use of the erection clip 316 and will serve to maintain the wall panels 300*a* and 300*b* in secure relationship by drawing the triangular projection 332 and triangular groove 338 together.

Mortar, or any other suitable construction adhesive, may be applied to the side male interlock 330 or the side female interlock 336 before such assembly in order to bind the walls together.

The corner pieces illustrated in FIGS. 2 and 3 may be used with the wall panels of this embodiment. Furthermore, similar to the embodiments shown in FIGS. 2, 3, 5*a* or 5*b*, 6, 7, and as shown in FIG. 14 adjacent wall panels 300 may be tied together and placed under lateral tension via tension cables 62 threaded through the clip grooves 339 and 340. As shown in FIGS. 2 and 3, the tension cable 62 may be secured at each end to an eyebolt assembly 64 and used to compress adjacent wall panels 300 together as already explained.

Similar to the embodiments shown in FIGS. 2, 4*a* or 4*b*, 5*a* or 5*b*, 6, and 7 the panels are assembled in a vertical direction by simply placing one wall panel on top of another wall panel such that the top male configuration 318 engages the bottom female configuration 324. As with the side-to-side assembly, mortar or other suitable construction adhesive may be used during such assembly.

Furthermore, and similar to the embodiments shown in FIGS. 4*a* or 4*b*, 5*a* or 5*b*, 6 and 7, special prefabricated pieces may be used with the wall panels 300 as lintels to span door, window or other desired openings and special prefabricated pieces may be used as floor or roof beams or as floor or roof supports.

Similar to the embodiments shown in FIGS. 5*a*–11, one of the further advantages of this invention is that it can be manufactured through an extrusion process. As shown in FIG. 13, this embodiment can be extruded in the direction "B." The die would have the appropriate shape to form the desired first side edge 306 and second side edge 308 and would also have mandrels to form the weight and material-saving cavities 312 and 314. Depending upon the height of the wall panel desired, the panels being extruded would be cut such that the extruded panel would have a bottom edge 304 defining a bottom female configuration 324 while the top edge 302 of the wall panel being extruded next would have a top edge 302 defining a male configuration, or vice versa. If used in the manner of construction shown in FIGS. 4*a* and 5*a*, it is expected that such wall panels would generally have the dimensions of 3 to 4 feet high by 8 to 9 feet long by 6 to 12 inches in length. However, if used in the preferred manner of construction, as shown in FIGS. 4*b* and 5*b*, it is expected that such wall panels would generally have the dimensions of 9 to 14 feet high by 3 to 6 feet long by 6 to 12 inches in width. Of course, any of these dimensions can obviously be varied. If wall cavities are utilized such as 312 and 314, it is anticipated that the preferred outer wall thickness will be in the range of one-half to one inch.

Also similar to the embodiments shown in FIGS. 1–11, and in particular FIG. 11, the modular building system of this embodiment can be used simply by reversing the orientation of the wall panel such that the top edge serves as the bottom edge while the bottom edge serves as the top edge.

It is understood, of course, that while the forms of the invention shown and described here constitute embodiments of the invention, they are not intended to illustrate all possible forms. It should also be understood that the words used are words of description rather than limitation, and that various changes may be made without departing from the spirit and scope of the invention disclosed and claimed.

What is claimed is:

1. A modular building system comprising one or more wall panels having a top edge defining one of a male or female configuration and a bottom edge defining the other one of a male or female configuration such that the top edge of one wall panel can mate with the bottom edge of an upper wall panel;

a first side edge defining one of a male or female interlock and a second side edge defining the other one of a male or female interlock such that the first side edge of one wall panel can interlock with the second side edge of another wall panel; and a connector extending from one wall panel to another to secure the first side edge of the one wall panel in position with the second side edge of another wall panel.

2. The modular building system of claim 1 wherein the connector is a clip which has an L-shaped configuration having a horizontal clip portion connected to and extending laterally from one wall panel and a vertical clip portion spaced apart from the one wall panel; and another wall panel defining a vertical erection cavity such that the vertical clip portion of the clip of one wall panel will engage the vertical erection cavity of another wall panel.

3. The modular building system of claim 2 wherein the vertical clip portion of the clip has a tapered clip surface and the vertical erection cavity has a tapered cavity wall such that the tapered clip surface will engage the tapered cavity wall during erection and draw one wall panel into an abutting relationship with another wall panel.

4. The modular building system of claim 1 wherein one of the male and female configuration defines a cable aperture extending from the first side edge to the second side edge.

5. The modular building system of claim 4 further comprising a cable which can be threaded through the cable apertures between two or more wall panels wherein the cable has a first cable end and a second cable end and a first cable locking mechanism at the first cable end and a second cable locking mechanism at the second cable end to prevent the first cable end or the second cable end from being pulled through the cable apertures thereby securing the two or more wall panels in adjacent positions.

6. The modular building system of claim 5 wherein the first cable locking mechanism is a threaded eyebolt assembly and the second cable locking mechanism is a threaded eyebolt assembly.

7. The modular building system of claim 1 wherein the wall panel defines a cavity.

8. The modular building system of claim 7 wherein the connector has a generally U-shaped configuration having one prong which can be inserted into one cavity of one wall and another prong which can be inserted into another cavity of another wall to secure the one wall and another wall in adjacent positions.

9. The modular building system of claim 8 wherein the connector has contact points which draw the one wall and another wall together as the clip is inserted into the one cavity and another cavity.

10. The modular building system of claim 1 further comprising a corner piece defining a male side interlock and a female side interlock.

11. The modular building system of claim 2 further comprising a floor support having a floor support projection and the top length defining one of a male or female configuration and the bottom length defining the other one of a male or female configuration such that the floor support can be mated with adjacent, wall panels.

12. The modular building system of claim 1 further comprising a roof cap piece having a roof cap projection and roof cap bottom defining one of a male or a female configuration such that the roof support bottom can mate with an adjacent underlying wall panel.

13. The modular building system of claim 1 further comprising a roof cap piece having a top bearing surface and the roof cap bottom defining one of a male or a female configuration such that it can mate with adjacent wall panels.

14. The modular building system of claim 1 further comprising a floor panel having a bottom floor panel edge defining one of a male or female configuration such that it can mate with adjacent underlying wall panels.

15. The modular building system of claim 1 further comprising a roof panel having a bottom roof panel edge defining one of a male or female configuration such that it can mate with adjacent underlying wall panels.

16. The modular building system of claim 1 wherein the male configuration comprises male projections defining a slot and the female configuration comprises a female groove such that the male projections will fit within and thereby mate with the female groove in such a manner that a void is left in at least a portion of the slot.

17. The modular building system of claim 16 further comprising a cable which can be threaded through the void between two or more wall panels wherein the cable has a first cable end and a second cable end and a first cable locking mechanism at the first cable end and a second cable locking mechanism at the second cable end to prevent the first cable end or the second cable end from being pulled through the void thereby securing the two or more wall panels in adjacent positions.

18. A modular building system comprising wall panels having a top edge defining either a male or female configuration and a bottom edge defining the other of a male or female configuration such that the top edge of one wall panel can mate with the bottom edge of an upper wall panel;

the wall panels having a first side edge defining either a male or female interlock and a second side edge defining the other of a male or female interlock such that the first side edge of one wall panel can interlock with the second side edge of another wall panel, one of the male and female configuration defining a cable aperture extending from the first side edge to the second side edge;

a cable which can be threaded through the cable aperture between two or more wall panels, the cable having a first cable end and a second cable end and a cable locking mechanism at the first cable end and a second cable locking mechanism at the second cable locking end to prevent the first cable end or the second cable end from being pulled through the cable apertures thereby securing the two or more wall panels in adjacent positions; and a connector extending from one wall panel to another to secure the first side edge of the one wall panel in position with the second side edge of another wall panel.

19. The modular building system of claim 18 wherein the first cable locking mechanism is a threaded eyebolt assembly and the second cable locking mechanism is a threaded eyebolt assembly.

20. The modular building system comprising wall panels manufactured by extruding the panels through a die, the wall panels having a top edge defining one of a male or female configuration and a bottom edge defining the other one of a male or female configuration such that the top edge of one wall panel can mate with the bottom edge of an upper wall panel;

a first side edge defining one of a male or female interlock and a second side edge defining the other one of a male or female interlock such that the first side edge of one wall panel can interlock with the second side edge of another wall panel; and a connector extending from one wall panel to another to secure the first side edge of the one wall panel in position with the second side edge of another wall panel.

21. The modular building system of claim 20 wherein the wall panels are extruded parallel to the top edge such that the die would form the configuration of the top edge and the bottom edge and the panels would be cut to form the male and female interlocks.

22. The modular building system of claim 20 wherein the wall panels are extruded parallel to the first side edge such that the die would form the configuration of the male and female interlocks and the panels would be cut to form the top edge and bottom edge.

* * * * *